United States Patent [19]

Kelly et al.

[11] 4,258,553

[45] Mar. 31, 1981

[54] VAPOR COMPRESSION REFRIGERATION SYSTEM AND A METHOD OF OPERATION THEREFOR

[75] Inventors: James B. Kelly, Chittenango; David S. Wilson, Fayetteville, both of N.Y.

[73] Assignee: Carrier Corporation, Syracuse, N.Y.

[21] Appl. No.: 8,920

[22] Filed: Feb. 5, 1979

[51] Int. Cl.[3] ..... F25B 41/00

[52] U.S. Cl. ..... 62/117; 62/197; 62/505

[58] Field of Search ..... 62/197, 505, 206, 217

[56] References Cited

U.S. PATENT DOCUMENTS

| | | | |
|---|---|---|---|
| 2,363,273 | 11/1944 | Waterfill . | |
| 3,276,221 | 10/1966 | Crumley | 62/197 |
| 3,482,327 | 12/1969 | Dutcher | 34/12 |
| 3,631,684 | 1/1972 | Randall | 62/197 X |
| 3,698,204 | 10/1972 | Schlotterbeck et al. | 62/206 |
| 3,992,784 | 11/1976 | Verschuur et al. | 34/12 |

*Primary Examiner*—William E. Wayner

*Attorney, Agent, or Firm*—J. Raymond Curtin; John S. Sensny

[57] ABSTRACT

A vapor compression refrigeration system comprising a compressor, a condenser, an expansion device, and an evaporator connected to form a refrigeration circuit. The system also includes a modulating valve and control means therefor for modulating a flow of refrigerant from the evaporator to the compressor to control the refrigerant flow through the compressor and the capacity of the refrigeration system. The refrigeration system further comprises a bypass line, a quench valve, and control means therefor for interjecting condensed refrigerant into the refrigeration circuit prior to the compressor and subsequent to the modulating valve in response to a predetermined refrigerant flow rate through the compressor.

9 Claims, 3 Drawing Figures

VAPOR COMPRESSION REFRIGERATION SYSTEM AND A METHOD OF OPERATION THEREFOR

BACKGROUND OF THE INVENTION

This invention relates generally to vapor compression refrigeration systems, and more particularly to a vapor compression refrigeration system having means for interjecting relatively cool liquid refrigerant into evaporated refrigerant prior to the compressor of the system.

Vapor compression refrigeration systems generally comprise a compressor, a condenser, an expansion device, and an evaporator connected by appropriate refrigerant lines to form a refrigeration circuit. Refrigerant vapor is compressed by the compressor and fed to the condenser where the refrigerant releases heat to a cooling medium and condenses. The condensed refrigerant then flows through the expansion device where the pressure and temperature of the refrigerant are reduced. From the expansion device, the refrigerant passes into the evaporator, absorbs ambient heat, and vaporizes. Vaporous refrigerant is then drawn back into the compressor completing the circuit.

Refrigeration systems of the foregoing type are frequently cycled on and off to produce a heat transfer medium having a generally uniform temperature or to maintain a desired temperature in a room or building. This type of control, however, often produces undesirably wide temperature fluctuations. To provide a more uniform temperature it has been proposed heretofore to control the cooling capacity of this type of refrigeration system by throttling the flow of refrigerant from the evaporator to the compressor. By throttling refrigerant passing to the compressor, the refrigerant flow rate through the entire refrigeration system can be varied. The amount of refrigerant passing through the evaporator can be regulated to control the amount of heat absorbed thereby. In this manner, the refrigeration system may provide a heat transfer medium having a substantially constant temperature despite changes in the cooling load of the heat transfer medium.

Compressors of the above-described refrigeration systems often comprise a hermetically or semi-hermetically sealed casing enclosing a vapor compression means and an electric motor for driving the compression means. Refrigerant returning from the evaporator is directed into the casing for compression, and this refrigerant cools the compressor, and more important the windings of the electric motor. When refrigerant is throttled prior to entering the compressor, the refrigerant may be unable to sufficiently cool the motor windings, causing overheating thereof. This may endanger the components of the compressor, particularly the motor, or the overheating may activate various safety switches, rendering the compressor motor and, hence, the refrigeration system inoperable.

SUMMARY OF THE INVENTION

In light of the above, an object of the present invention is to improve vapor compression refrigeration systems.

An additional object of this invention is to employ condensed refrigerant to cool the compressor of a vapor compression refrigeration system under low load conditions.

Another object of this invention is to interject cool refrigerant into evaporated refrigerant prior to the compression thereof in response to a predetermined refrigerant flow rate through the compressor.

A further object of the present invention is to modulate evaporated refrigerant prior to the compressing thereof in proportion to the magnitude of a control signal and to interject cool refrigerant into the evaporated refrigerant in response to the control signal reaching a predetermined magnitude.

A still another object of this invention is to vary the position of a modulating valve for modulating evaporated refrigerant prior to the compression thereof in proportion to the magnitude of a control signal and to interject cool refrigerant into the evaporated refrigerant in response to the modulating valve reaching a predetermined position.

These and other objectives are attained with a vapor compression refrigeration system comprising a compressor, a condenser, an expansion device, and an evaporator connected to form a refrigeration circuit. The system further comprises modulating means for modulating the flow of refrigerant from the evaporator to the compressor to control the refrigerant flow through the compressor and the capacity of the refrigerant system, and means for interjecting cool refrigerant into the refrigeration circuit prior to the compressor and subsequent to the modulating means in response to a predetermined refrigerant flow rate through the compressor.

DESCRIPTION OF THE PREFERRED EMBODIMENT

Figure 1:
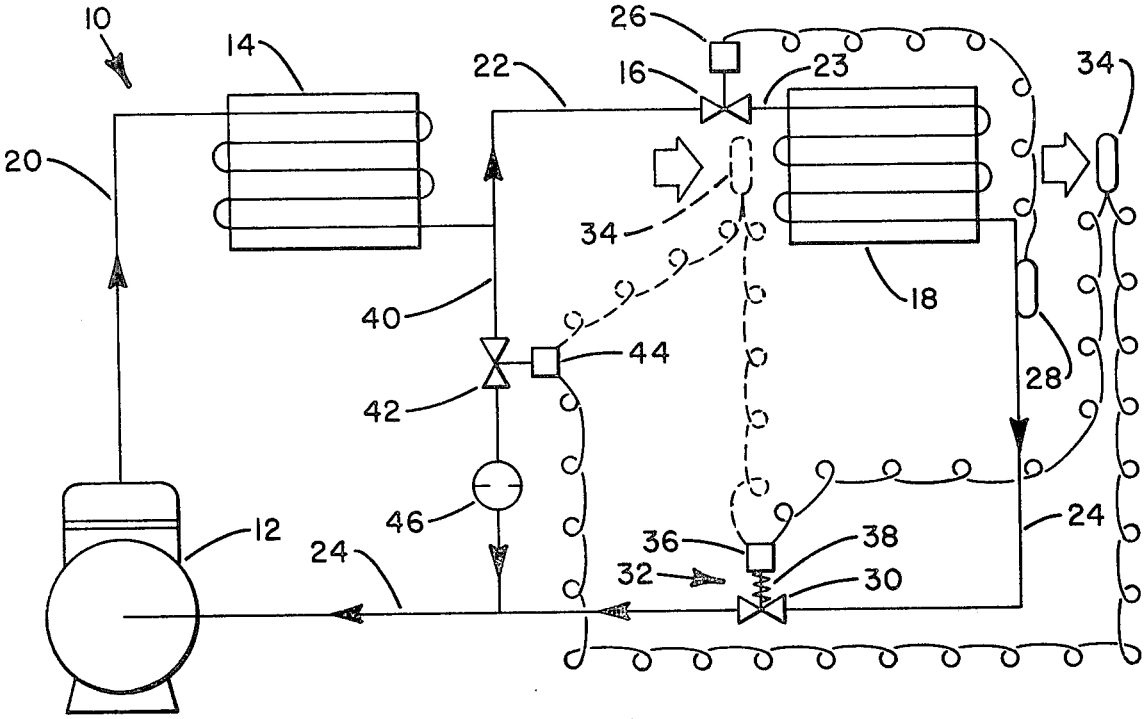
FIG. 1 is a schematic representation of a vapor compression refrigeration system constructed according to the present invention.

Referring to FIG. 1, a vapor compression refrigeration system is shown and referenced generally as 10. System 10 includes compressor 12, condenser 14, variable expansion means 16, and evaporator 18 connected by refrigeration lines 20, 22, 23 and 24 to form a closed loop refrigeration circuit. Compressor 12 discharges hot, compressed refrigerant vapor into line 20, which leads to condenser 14. Refrigerant passes through condenser 14 and gives up heat to an external heat exchange medium such as air moving thereover. As refrigerant passes through condenser 14, the refrigerant condenses and liquid refrigerant proceeds through line 22 and through variable expansion means 16. Expansion means 16, discussed in greater detail below, reduces the temperature and pressure of refrigerant passing therethrough. The expanded refrigerant proceeds through line 23 and through evaporator 18 where the refrigerant absorbs heat from an external heat exchange medium such as air moving thereover. The refrigerant vaporizes as it passes through evaporator 18, and vaporous refrigerant is discharged from the evaporator into line 24 leading back to compressor 12.

The air moving over evaporator 18 may be used for a number of different purposes, for example to cool a room or building (not shown) and then returned to the evaporator. The air moves over evaporator 18 from left to right as viewed in FIG. 1 and as represented by the arrows therein, and air to the right of the evaporator is referred to as supply air while air to the left of the evaporator is referred to as return air. The load on refrigeration system 10, represented by the air moving over evaporator 18, varies and the evaporator cools that air to a substantially constant final temperature. Any suitable means may be employed to control the operation of evaporator 18 in such a way to meet this last-mentioned requirement. In the system depicted in FIG. 1, the control includes variable expansion means 16 and positioning means 26, which may be of any suitable type such as electric, pneumatic, or hydraulic positioners. Positioning means 26 controls the amount of refrigerant passing through expansion means 16 in response to variations in the load on system 10 as reflected by changes in the temperature of vapor leaving evaporator 18. This temperature is sensed by sensing means 28 which also may be of any suitable type, for example a thermo-sensitive bulb.

To obtain a finer, more precise control of the evaporator temperature, system 10 further includes modulating means for modulating the flow of evaporator refrigerant from evaporator 18 to compressor 12 to control the refrigerant flow through the compressor and the capacity of refrigeration system 10. In the embodiment illustrated in the drawings, the modulating means includes valve 30 located in refrigerant line 24 and movable between a minimum modulating position and a maximum modulating position. Preferably, in the minimum modulating position, valve 30 is in a full open position wherein the valve has a minimum effect on the flow of refrigerant through line 24; and, in the maximum modulating position, valve 30 is in a closed position, restricting but not completely preventing refrigerant from flowing through line 24. Valve 30 is controlled by controller 32 for positioning the modulating valve between the minimum and maximum modulating positions. Controller 32 may be responsive to any one of a number of control parameters indicative of the load on refrigeration system 10 such as ambient temperature, the supply air temperature, the return air temperature, or the power used to operate compressor 12. The control parameter is sensed by sensing means 34. As shown in full lines in FIG. 1, sensing means 34 is positioned to sense supply air temperature. Alternately, as shown in broken lines in FIG. 1, sensing means 34 may be positioned to sense return air temperature.

As the load on system 10 increases and the supply air and return air temperatures increase, controller 32 moves valve 30 toward the full open position, allowing a greater flow of refrigerant therethrough. More refrigerant passes through compressor 12 and evaporator 18 allowing refrigeration system 10 to respond to the increased load. In contrast, if the load on system 10 decreases, then the supply air and return air temperatures also decrease. This decrease is sensed by sensing means 34, and controller 32 moves valve 30 toward the closed position, restricting refrigerant flow through compressor 12 and system 10.

Preferably, controller 32 includes electrically actuated solenoid 36 and spring 38. Spring 38 exerts a force on valve 30 urging the valve towards the full open position, and solenoid 36 exerts a variable force on valve 30 urging the valve towards the closed position. The magnitude of the force exerted by solenoid 36 depends on the amount of current passing therethrough, with the force increasing as the current increases. When no current flows through solenoid 36, the solenoid has a minimal effect on valve 30, and the valve is maintained in the full open position by spring 38. As the current through solenoid 36 increases, valve 30 moves proportionally toward the closed position. In this manner, solenoid 36 and springs 38 cooperate to position valve 30 between the full open position and the closed position in proportion to the current passing through the solenoid.

Refrigerant vapor flowing through compressor 12 cools the compressor, particularly the electric motor (not shown) thereof. As the refrigerant vapor flow is restricted by valve 30, the refrigerant flow may become insufficient to adequately cool the compressor. In order to ensure proper cooling of compressor 12, system 10 includes means for interjecting cool, condensed refrigerant into the evaporated refrigerant passing through line 24 subsequent to modulating valve 30 and prior to compressor 12 in response to the refrigerant flow through the compressor reaching a predetermined valve. The condensed refrigerant mixes with the vapor in line 24 and causes a reduction in the temperature of the refrigerant passing through line 24 and compressor 12. The cooler refrigerant is better able to cool compressor 12, ensuring proper operation thereof. Further, cooling the refrigerant vapor inhibits decomposition of the oil which circulates with the refrigerant vapor through system 10 and which is employed to lubricate elements of compressor 12, improving the ability of the oil to satisfactorily perform this lubrication.

As illustrated in FIG. 1, the interjecting means includes bypass line 40 for conducting condensed refrigerant from line 22 into refrigerant line 24 subsequent to valve 30 and prior to compressor 12, and quench valve means for controlling refrigerant flow through the bypass line. The quench valve means, preferably a conventional valve 42, has an open position, wherein refrigerant passes through bypass line 40, and a closed position for preventing refrigerant from passing through the bypass line. Quench valve control means is provided for moving quench valve 42 from the closed position to the open position in response to the refrigerant flow rate through compressor 12 reaching the predetermined valve. More particularly, the quench valve control means includes electrically actuated solenoid 44 having an open position for maintaining quench valve 42 in the open position and a closed position for maintaining the quench valve in the closed position, wherein the passage of an electric current through solenoid 44 moves the solenoid from the closed position to the open position.

Preferably, orifice 46 is located in bypass line 40 for restricting the flow of refrigerant through the bypass line and thereby reducing the pressure of the refrigerant flowing therethrough. In this manner, orifice 46 helps to maintain the pressure difference between the higher pressure, condensed refrigerant in line 22 and the lower pressure, evaporated refrigerant in line 24. Orifice 46 also prevents excessive refrigerant from entering line 24 and passing to compressor 12. As may be apparent to one skilled in the art, orifice 46 is not necessary to the present invention, and quench valve 42 may be used to restrict the flow of refrigerant through bypass line 40. However, this would require a quench valve which would reliably open to a relatively precisely sized open position. Using a fixed sized opening such as orifice 46 to restrict refrigerant flow through bypass line 40 obviates the need for a more reliable and accurate, and hence more costly, quench valve.

Figure 2:
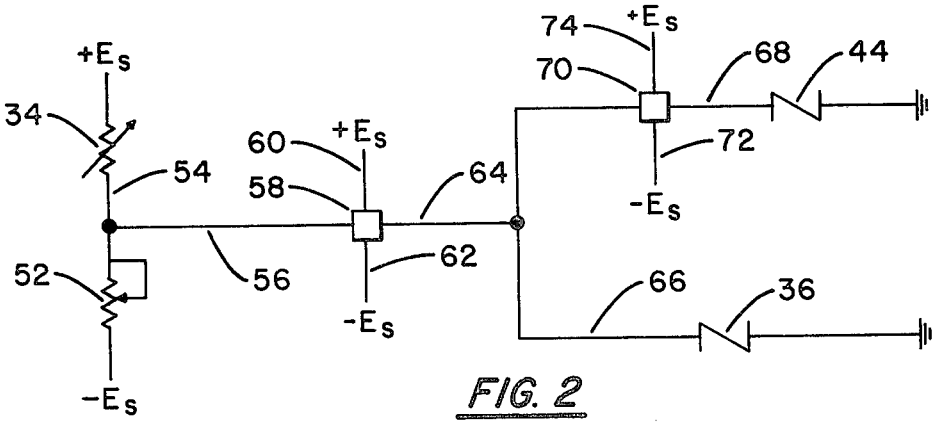
FIG. 2 is a schematic drawing of an electronic control circuit for use with the refrigeration system shown in FIG. 1.
Figure 3:
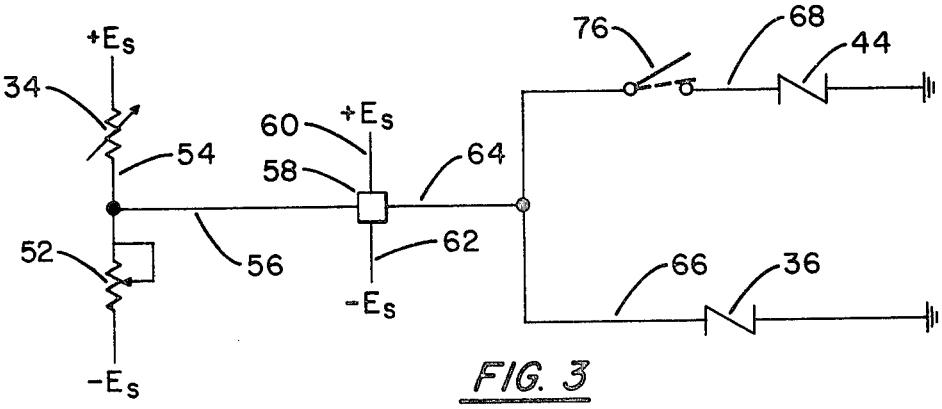
FIG. 3 is a schematic drawing of an alternate electronic control circuit for use with the refrigeration system shown in FIG. 1.

As mentioned previously, the controls for modulating valve 30 and quench valve 42 include electrically actuated solenoids 36 and 44, and control circuits therefore are schematically illustrated in FIGS. 2 and 3. Because valves 30 and 42 are controlled by electrically actuated means, sensing means 34 preferably includes a variable electronic resistance element for varying the magnitude of an electronic signal passing therethrough. The variable electronic resistance element is in communication with the control parameter, preferably the supply air temperature. In the preferred arrangement depicted in the drawings, the variable electronic resistance element includes NTC resistor 34 whose resistance inversely increases with supply air temperature. It will be apparent to one skilled in the art, however, that with appropriate changes, a PTC resistor, whose resistance directly increases with supply air temperature could also be used. The electric circuits shown in FIGS. 2 and 3 are designed for use with a DC voltage represented by $+E_s$ and $-E_s$. Generally, a DC voltage is not readily available, but an AC voltage is available. Accordingly, a full wave diode rectifier is usually provided for converting the AC voltage to the DC voltage. Such rectifiers are well known in the art, and it is unnecessary to describe them herein.

The electrical control circuits illustrated in the drawings further include resistor 52 located in line 54 in series with variable resistor 34 between the DC voltage source. The voltage drop across resistor 52 represents the set point temperature, and the DC voltage source and resistors 34 and 52 produce a variable voltage signal in line 56 indicative of the difference between the supply air temperature and the set point temperature. Specifically, the set point temperature is defined as that temperature of the supply air which causes the resistance of sensing means 34 to equal the resistance of resistor 52, wherein the voltage signal in line 56 has zero magnitude. When the supply air temperature is above the set point temperature, the voltage drop across variable resistor 34 is less than the voltage drop across resistor 52, and a voltage of positive plurality is produced in line 56. In contrast, when the supply air temperature is below the set point temperature, the voltage drop across resistor 34 is greater than the voltage drop across resistor 52, and a voltage signal of negative plurality is produced in line 56. Furthermore, preferably resistor 52 is a variable resistor such as a potentiometer whose resistance, and hence the set point temperature, can be adjusted by an operator.

The voltage signal in line 56 is applied to electronic element 58. Electronic element 58, connected to the DC power source by lines 60 and 62, includes a voltage to current converter. More particularly, as the voltage signal applied to converter 58 decreases from a maximum positive value, the current output from the converter rises from zero toward a maximum value, and the maximum current output is reached when the voltage input is zero. Preferably, element 58 is a solid state electronic element and may perform other functions, for example deactivating compressor 12 when the supply air temperature falls below set point. In this case, element 58 preferably further acts to prevent current from passing therefrom when the supply air temperature falls below set point. The output from electronic element 58 is applied to line 64 and from there to lines 66 and 68. Solenoid 36 is located in line 66 and, as the current therein increases, the solenoid, acting against spring 38, moves modulating valve 30 from the full open position toward the closed position. This gives a gradual reduction in the amount of refrigerant vapor passing through modulating valve 30 and compressor 12.

Solenoid 44 is located in line 68 and, in the embodiment illustrated in FIG. 2, electronic triggering element 70, for example, a device known in the art as a "Schmitt Trigger," is also located in line 68 in series with solenoid 44. Triggering element 70 is connected to the DC power source through lines 72 and 74. When the current input to trigger 70 is below a predetermined value, the trigger acts to prevent the current from passing therethrough and, thus, to prevent current from passing through solenoid 44. In this event, solenoid 44 is maintained in the closed position, keeping quench valve 42 closed. When the current input to trigger 70 reaches or exceeds the predetermined value, the current passes through the trigger and through solenoid 44. Solenoid 44 is moved to the open position, moving quench valve 42 to the open position and allowing liquid refrigerant to pass through bypass line 40. Thus, cool refrigerant is interjected into refrigerant line 24 in response to the current in electrical line 68 reaching a predetermined magnitude.

In the embodiment illustrated in FIG. 3, condensed refrigerant is interjected into line 24 in response to modulating valve 30 reaching a predetermined position. More specifically, limit switch 76 is physically located in communication with modulating valve 30 and electrically positioned in line 68 in series with solenoid 44. Limit switch 76 is moved from an open position to a closed position in response to movement of modulating valve 30 to the predetermined position. In the open position, shown in full line in FIG. 3, switch 76 prevents current from passing through line 68 and through solenoid 44, and in the closed position, shown in broken lines in FIG. 3, switch 76 allows current to pass through line 68 and through solenoid 44. When current passes through solenoid 44, the solenoid is moved to the open position, opening quench valve 42 to interject cool, condensed refrigerant into refrigerant line 24.

Refrigeration system 10, with bypass line 40, valves 30 and 42, and solenoids 36 and 44, functions as follows. When the supply air temperature is at a maximum because, for example, system 10 has been inactive for a period or a maximum load is suddenly imposed thereon, the resistance of resistor 34 is at a minimum, the voltage signal in electrical line 56 has a maximum positive value, and there is zero current output from voltage to current converter 58. No current flows through either solenoid 36 or 44. Quench valve 42 is closed and modulating valve 30 is held in the full open position by spring 38. Maximum refrigerant flows through compressor 12, condenser 14, and evaporator 18 to cause maximum chilling of the air passing over the evaporator. Generally, this is more than sufficient to satisfy the load on system 10, and this fact is reflected by a decrease in the supply air temperature. This increases the resistance of resistor 34, increasing the voltage drop thereacross and decreasing the magnitude of the voltage signal in line 56. As the magnitude of the voltage signal in line 56 decreases, the current output from voltage to current converter 58 increases. The current in line 66 increases, increasing the current through solenoid 36, and the solenoid moves modulating valve 30 toward the closed position, restricting refrigerant flow through compressor 12 and system 10. If the supply air temperature continues to decrease and approach the set point temperature, then modulating valve 30 continues to move closer to the closed position, further restricting the refrigerant flow through refrigerant line 24, compressor 12, and refrigeration system 10.

When the flow through compressor 12 diminishes to a predetermined rate, quench valve 42 is opened, and condensed refrigerant passes from refrigerant line 22, through bypass line 40, through quench valve 42 and orifice 46, and into refrigerant line 24. Condensed refrigerant vaporizes as it passes into and through refrigerant line 24, and the interjected refrigerant mixes with and cools the vapor passing through line 24 and compressor 12. More particularly, with the control circuit shown in FIG. 2, when the supply air reaches a predetermined temperature above the set point, the DC voltage source, resistors 34 and 52, and converter 58 produce a predetermined current in electrical lines 64, 66, and 68. This predetermined current passes through solenoid 36 and the solenoid moves valve 30 to a predetermined position, allowing a predetermined flow of refrigerant through compressor 12. At the same time, the predetermined current is sufficient to pass through trigger 70, opening solenoid 44 which opens quench valve 42. With the control circuit shown in FIG. 3, when the supply air reaches the predetermined temperature and the predetermined current passes through electrical line 46, modulating valve 30 is moved to the predetermined position, closing limit switch 76. Current passes through electrical line 48, opening solenoid 44 and quench valve 42.

While is is apparent that the invention herein disclosed is well calculated to fulfill the objects above-stated, it will be appreciated that numerous modifications and embodiments may be devised by those skilled in the art, and it is intended that the appended claims cover all such modifications and embodiments as fall within the true spirit and scope of the present invention.

What is claimed is:

1. A method of operating a vapor compression refrigeration system comprising the steps of:

compressing a flow of evaporated refrigerant to increase the temperature and pressure thereof;

condensing compressed refrigerant;

expanding condensed refrigerant to decrease the temperature and pressure thereof;

evaporating expanded refrigerant;

varying the magnitude of a control signal in response to the difference between a control parameter indicative of a load on the refrigeration system and a set point;

modulating the flow of evaporated refrigerant prior to the compression thereof in proportion to the magnitude of the control signal to control the flow of evaporated refrigerant and the capacity of the refrigeration system; and interjecting cool refrigerant into the evaporated refrigerant subsequent to the modulation and prior to the compression thereof in response to the control signal reaching a predetermined magnitude.

2. A method of operating a vapor compression refrigeration system comprising the steps of:

compressing a flow of evaporated refrigerant to increase the temperature and pressure thereof;

condensing compressed refrigerant;

expanding condensed refrigerant to decrease the temperature and pressure thereof;

evaporating expanded refrigerant;

varying the magnitude of a control signal in response to the difference between a control parameter indicative of a load on the refrigeration system and a set point;

modulating the flow of evaporated refrigerant prior to the compression thereof in proportion to the magnitude of the control signal to control the flow of evaporated refrigerant and the capacity of the refrigeration system; and interjecting cool refrigerant into the evaporated refrigerant subsequent to the modulation and prior to the compression thereof in response to the modulation of evaporated refrigerant reaching a predetermined value.

3. A vapor compression refrigeration system comprising:

a compressor, a condenser, an expansion device, and an evaporator connected to form a refrigeration circuit;

means to generate a control signal;

means to vary the magnitude of the control signal in response to the difference between a control parameter indicative of a load on the refrigeration system and a set point;

modulating means for modulating a flow of refrigerant from the evaporator to the compressor to control the refrigerant flow through the compressor and the capacity of the refrigeration system, and including a modulating valve located in the refrigeration circuit between the evaporator and compressor and movable between a minimum modulating position and a maximum modulating position, and modulating valve control means for positioning the modulating valve between the minimum modulating position and the maximum modulating position for modulating the vapor flow through the modulating valve in proportion to the magnitude of the control signal; and means for interjecting cool refrigerant into the refrigeration circuit prior to the compressor and subsequent to the modulating means, and including a bypass line for conducting condensed refrigerant around the evaporator and into the refrigeration circuit prior to the compressor and subsequent to the modulating means, quench valve means for controlling refrigerant flow through the bypass line and having an open position, wherein refrigerant passes through the bypass line, and a closed position for preventing refrigerant from passing through the bypass line, and quench valve control means for moving the quench valve means from the closed position to the open position in response to the control signal reaching a predetermined magnitude.

4. A vapor compression refrigeration system comprising:

a compressor, a condenser, an expansion device, and an evaporator connected to form a refrigeration circuit;

means to generate a control signal;

means to vary the magnitude of the control signal in response to the difference between a control parameter indicative of a load on the refrigeration system and a set point;

modulating means for modulating a flow of refrigerant from the evaporator to the compressor to control the refrigerant flow through the compressor and the capacity of the refrigeration system, and including a modulating valve located in the refrigeration circuit between the evaporator and compressor and movable between a minimum modulating position and a maximum modulating position, and modulating valve control means for positioning the modulating valve between the minimum modulating position and the maximum modulating position for modulating the vapor flow through the modulating valve in proportion to the magnitude of the control signal; and means for interjecting cool refrigerant into the refrigeration circuit prior to the compressor and subsequent to the modulating means, and including a bypass line for conducting condensed refrigerant around the evaporator and into the refrigeration circuit prior to the compressor and subsequent to the modulating means, quench valve means for controlling refrigerant flow through the bypass line and having an open position, wherein refrigerant passes through the bypass line, and a closed position for preventing refrigerant from passing through the bypass line, and quench valve control means for moving the quench valve means from the closed position to the open position in response to the modulating valve reaching a predetermined position.

5. The invention as defined by claim 3, wherein:

the generating means includes a source of an electric signal;

the varying means includes a variable electronic resistance means in communication with the control parameter and positioned in series with the source of the electronic signal for varying the magnitude of the electronic signal in response to changes in the control parameter;

the modulating valve control means includes first electrially actuated means positioned in series with the variable resistance element for positioning the modulating valve between the minimum modulating position and the maximum modulating position in proportion to the magnitude of the electronic signal; and the quench valve control means includes second electrically actuated means having an open position for maintaining the quench valve means in the open position and a closed position for maintaining the quench valve means in the closed position, and electronic triggering means positioned electrically in series between the variable electronic resistance element and the second electrically actuated means for moving the second electrically actuated means from the closed position to the open position in response to the electronic signal reaching a predetermined magnitude.

6. The invention as defined by claim 4 wherein:

the generating means includes a source of an electronic signal;

the varying means includes a variable electronic resistance means in communication with the control parameter and positioned in series with the source of the electronic signal for varying the magnitude of the electronic signal in response to changes in the control parameter;

the modulating valve control means includes first electrically actuated means positioned in series with the variable resistance means for positioning the modulating valve between the minimum modulating position and the maximum modulating position in proportion to the magnitude of the electronic signal; and the quench valve control means includes second electrically actuated means having an open position for maintaining the quench valve means in the open position and a closed position for maintaining the quench valve means in the closed position, and a switch mechanically located in communication with the modulating valve, electrically positioned in series between the variable resistance means and the second electrically actuated means, having an open position for preventing the electrical signal from passing therethrough, wherein the second electrically actuated means is maintained in the open position, and a closed position for passing the electronic signal therethrough, wherein the second electrically actuated means is maintained in the closed position, and wherein the switch moves from the closed position to the open position in response to movement of the modulating valve to a predetermined position.

7. The invention as defined by claims 5 or 6 wherein the interjecting means further includes flow restricting means located in the bypass line for reducing the pressure of refrigerant passing therethrough.

8. The invention as defined by claims 1, 2, 5 or 6 wherein the refrigeration system supplies a cool heat transfer medium and the control parameter is the supply medium temperature.

9. The invention as defined by claims 1, 2, 5 or 6 wherein a heat transfer medium is returned to the refrigeration system for cooling and the control parameter is the return medium temperature.

* * * * *